US011131220B2

(12) United States Patent
Boese et al.

(10) Patent No.: US 11,131,220 B2
(45) Date of Patent: Sep. 28, 2021

(54) CAMSHAFT ADJUSTER

(71) Applicant: Schaeffler Technologies AG & Co. KG, Herzogenauarch (DE)

(72) Inventors: Olaf Boese, Nuremberg (DE); Jochen Thielen, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 277 days.

(21) Appl. No.: 15/778,446

(22) PCT Filed: Sep. 29, 2016

(86) PCT No.: PCT/DE2016/200457
§ 371 (c)(1),
(2) Date: May 23, 2018

(87) PCT Pub. No.: WO2017/088859
PCT Pub. Date: Jun. 1, 2017

(65) Prior Publication Data

US 2018/0355767 A1 Dec. 13, 2018

(30) Foreign Application Priority Data

Nov. 26, 2015 (DE) ..... 102015223464.9

(51) Int. Cl.
*F01L 1/344* (2006.01)
*F01L 1/047* (2006.01)
(Continued)

(52) U.S. Cl.
CPC ..... *F01L 1/3442* (2013.01); *F01L 1/047* (2013.01); *F01L 1/24* (2013.01); *F01L 1/352* (2013.01);
(Continued)

(58) Field of Classification Search
CPC . F01L 1/3442; F01L 1/047; F01L 1/24; F01L 1/352; F01L 2001/2444;
(Continued)

(56) References Cited

U.S. PATENT DOCUMENTS 5,947,067 A * 9/1999 Kawaharaguchi .... F01L 1/3442 123/90.17
7,610,883 B2 11/2009 Noguchi
(Continued)

FOREIGN PATENT DOCUMENTS

DE 102007037827 A1 3/2008
DE 102009042202 4/2011
(Continued)

*Primary Examiner* — Patrick Hamo
*Assistant Examiner* — Wesley G Harris
(74) *Attorney, Agent, or Firm* — Volpe Koenig

(57) ABSTRACT

A camshaft adjuster (1) is provided, including a drive element (2) and a driven element (3), which can be rotated in relation to the drive element within an angular range and can be connected to a camshaft, wherein pressurizable working chambers (4) for rotating the drive element (2) with respect to the driven element (3) are formed between the drive element (2) and the driven element (3), wherein the camshaft adjuster (1) has a volume accumulator (5) for collecting hydraulic medium, wherein the volume accumulator (5) supplies the hydraulic medium to a vacuum-pressurized working chamber (4) via a check valve (6) in that the vacuum in the working chamber (4) opens the check valve (6), characterized in that the check valve (6) is arranged in an axial position between the working chamber (4) and the volume accumulator (5), and the volume accumulator (5) is formed by a cover element (7) connected to the drive element (2) for conjoint rotation.

11 Claims, 7 Drawing Sheets

(51) Int. Cl.
*F01L 1/24* (2006.01)
*F01L 1/352* (2006.01)

(52) U.S. Cl.
CPC ..... *F01L 2001/2444* (2013.01); *F01L 2001/34423* (2013.01); *F01L 2001/34433* (2013.01)

(58) Field of Classification Search
CPC ... F01L 2001/34423; F01L 2001/34433; F01L 2001/34426; F01L 2001/34446; F01L 2001/3445; F01L 2001/34479; F01L 1/46; F16K 15/026; F16K 15/028; F16K 17/0413; F16K 17/0473; F16K 17/048; F16K 17/26
USPC ..... 123/90.17, 90.15; 137/512.5, 512, 513, 137/540, 538
See application file for complete search history.

(56) References Cited

U.S. PATENT DOCUMENTS 8,763,574 B2 7/2014 Plate et al.
8,776,747 B2 7/2014 Schafer et al.
8,863,712 B2 10/2014 Schafer et al.
8,869,761 B2 10/2014 Busse et al.
8,960,140 B2 2/2015 Schafer et al.
8,973,544 B2 3/2015 Busse et al.
8,991,344 B2 3/2015 Schafer et al.
2005/0103297 A1* 5/2005 Simpson ..... F01L 1/022 123/90.17
2006/0086332 A1* 4/2006 Simpson ..... F01L 1/34409 123/90.17
2012/0210961 A1* 8/2012 Scheidig ..... F01L 1/34409 123/90.15
2013/0133599 A1* 5/2013 Ikuma ..... F01L 1/34 123/90.17
2013/0199468 A1* 8/2013 Schafer ..... F01L 1/3442 123/90.15
2013/0199470 A1* 8/2013 Schafer ..... F01L 1/3442 123/90.15
2016/0053640 A1* 2/2016 Schafer ..... F01L 1/047 123/90.17
2017/0022849 A1* 1/2017 Haltiner, Jr. ..... F01L 1/3442

FOREIGN PATENT DOCUMENTS

DE 102010019530 11/2011
DE 102012201551 8/2013
DE 102012201558 8/2013
DE 102012201560 A1 8/2013
DE 102012201566 8/2013
DE 102012201567 A1 8/2013
DE 102012201570 8/2013
JP 2010255584 11/2010

* cited by examiner

CAMSHAFT ADJUSTER

FIELD OF THE INVENTION

The invention relates to a camshaft adjuster.

BACKGROUND OF THE INVENTION

Camshaft adjusters are used in internal combustion engines for varying the control timing of the combustion chamber valves, in order to be able to vary the phase relationship between a crankshaft and a camshaft in a defined angular range between a maximum advanced position and a maximum retarded position. Adapting the control times to the current load and rotational speed reduces fuel consumption and emissions. For this purpose, camshaft adjusters are integrated into a drivetrain by which torque is transferred from the crankshaft to the camshaft. This drivetrain can be formed, for example, as a belt, chain, or gearwheel drive.

In a hydraulic camshaft adjuster, the driven element and the drive element form one or more pairs of interacting pressure chambers that can be pressurized with hydraulic medium. The drive element and the driven element are in a coaxial arrangement. By filling and emptying individual pressure chambers, a relative movement between the drive element and the driven element is generated. A rotationally active spring between the drive element and the driven element forces the drive element in a preferred direction relative to the driven element. This preferred direction can be in the same direction or in the opposite direction relative to the direction of rotation.

One construction of the hydraulic camshaft adjuster is the vane cell adjuster. The vane cell adjuster has a stator, a rotor, and a drive wheel with external teeth. The rotor is constructed as a driven element that can be connected usually locked in rotation with the camshaft. The drive element includes the stator and the drive wheel. The stator and the drive wheel are locked in rotation with each other or are alternatively formed integrally with each other. The rotor is arranged coaxial to the stator and within the stator. The rotor and the stator form interacting oil chambers with their radially extending vanes, wherein these chambers can be pressurized by oil pressure and enable a relative rotation between the stator and the rotor. The vanes are either formed integrally with the rotor or the stator or are arranged as "stacked vanes" in grooves provided for this reason in the rotor or the stator. Furthermore, the vane cell adjusters have various sealing covers. The stator and the sealing covers are secured to each other by multiple threaded connections.

Another construction of the hydraulic camshaft adjuster is the axial piston adjuster. Here, a displacement element is axially displaced by oil pressure, which generates a relative rotation between a drive element and a driven element via helical gearing.

Another construction of a camshaft adjuster is the electromechanical camshaft adjuster that has a triple shaft drive (for example, a planetary gear). Here, one of the shafts forms the drive element and a second shaft forms the driven element. By the use of the third shaft, rotational energy can be fed to the system or discharged from the system by an actuator device, for example, an electric motor or brake. A spring can also be arranged that supports or feeds back the relative rotation between the drive element and driven element.

DE 10 2009 042 202 shows a device for the variable setting of the control times of gas exchange valves of an internal combustion engine with a hydraulic phase adjustment device and at least one volume accumulator, wherein the phase adjustment device can be brought into drive connection with a crankshaft and a camshaft and has at least one advanced adjustment chamber and at least one retarded adjustment chamber, wherein pressurizing medium can be fed to or discharged from this chamber via pressurizing medium lines, wherein a phase position of the camshaft relative to the crankshaft can be adjusted in the direction of earlier control times by the pressurizing medium feed to the advanced adjustment chamber with simultaneous pressurizing medium outflow from the retarded adjustment chamber, wherein a phase position of the camshaft relative to the crankshaft in the direction of retarded control times can be adjusted by pressurizing medium feed to the retarded adjustment chamber with simultaneously pressurizing medium outflow from the advanced adjustment chamber, wherein pressurizing medium can be fed to the volume accumulator or accumulators during the operation of the internal combustion engine.

DE 10 2010 019 530 shows a camshaft adjuster in vane cell construction with a stator and a rotor that can be rotated relative to the stator, as well as at least two pressure chambers that are formed between the stator and the rotor and are separated from each other by a radially oriented vane of the rotor, wherein a pressurizing medium can be alternately fed to the pressure chambers, wherein the vane has a radial surface and two side surfaces directed toward the pressure chambers and wherein the radial surface is sealed by a U-shaped sealing element with a base leg and two side legs contacting the side surfaces. Check valves are formed on the side legs and outlets for the pressurizing medium are formed on the side surfaces of the vane, with the check valves being allocated to these outlets. In this way, a volume accumulator for the pressurizing medium is formed, in particular, in the rotor, so that the established pressure can be maintained by this arrangement of the volume accumulator when the camshaft adjuster is adjusted. The oil is led out from there via the pressurizing medium channels into the interior of the vane and then fed via an outlet on the corresponding side surface of the vane into one of the chambers when a vacuum pressure is present in the chamber with respect to the volume accumulator.

DE 10 2012 201 566 shows a stator for a camshaft adjuster. The specified stator comprises an outer part for the concentric holding of a rotor with vanes arranged around the rotor and a segment projecting from the outer part for engaging between two vanes of the rotor, in order to form, together with the two vanes, pressure chambers of the camshaft adjuster. Here, the segment has a hollow space for holding a hydraulic fluid from the pressure chambers.

DE 10 2012 201 570 shows a stator for a camshaft adjuster that comprises a ring-shaped outer part for the concentric holding of a rotor with axially projecting vanes arranged circumferentially around the rotor, a segment projecting radially inward from the ring-shaped outer part for engaging between two vanes of the rotor, in order to form, together with the two vanes, pressure chambers of the camshaft adjuster, and a hollow space that is open to a pressure chamber via a check valve.

DE 10 2012 201 551 shows a directional valve for controlling a hydraulic oil flow from a pressure connection via work chambers of a camshaft adjuster to a tank connection. The directional valve comprises an accumulator connection for guiding at least one part of the hydraulic oil going out from a work chamber into a volume accumulator upstream of the outflow into the tank connection, wherein the accumulator connection is connected to the pressure connection by a channel.

DE 10 2012 201 558 shows a camshaft adjuster for a camshaft of an internal combustion engine. The specified camshaft adjuster comprises a stator, a rotor held concentrically in the stator and a rotor supported so that it can rotate relative to the stator about an axis of rotation and a volume accumulator for holding a hydraulic fluid from a pressure chamber formed between the rotor and the stator, wherein the volume accumulator has an outlet in the direction toward the axis of rotation.

JP 2010-255584 A shows a camshaft adjustment device with a camshaft adjuster and a pressure accumulator that is arranged in a decentralized position and pressures the oil fed to the work chamber, wherein the oil is guided through a check valve to the control valve and finally to the work chamber.

SUMMARY

The object of the invention is to provide a camshaft adjuster that has an especially simple construction of the volume accumulator and an especially simple arrangement of the check valves.

This object is achieved by a camshaft adjuster having one or more features of the invention.

Thus, the objective is achieved according to the invention by a camshaft adjuster with a drive element and a driven element that can rotate relative to the drive element within an angular range and can be connected to a camshaft, wherein work chambers that can be pressurized are formed between the drive element and the driven element for rotating the drive element relative to the driven element, wherein the camshaft adjuster has a volume accumulator for collecting hydraulic medium, wherein the volume accumulator feeds the hydraulic medium via a check valve to a vacuum-pressurized work chamber, in that the vacuum pressure in the work chamber opens the check valve, characterized in that the check valve is arranged in an axial position between the work chamber and the volume accumulator, wherein the volume accumulator is formed by a cover element locked in rotation with the drive element. The cover element is preferably arranged coaxial to the drive element.

In this way it is achieved that, on one hand, the volume accumulator can be stored in or formed by the cover element in a space-saving manner and, on the other hand, the hydraulic medium volume present in the cover element arranged axially adjacent to the work chamber can be fed by the arrangement of the check valves according to the invention on the shortest possible path to the work chamber. Therefore, the reaction time for feeding hydraulic medium in the case of vacuum pressure in a work chamber is considerably improved and the leakage of the feed channel from the volume accumulator to the work chamber is reduced. Furthermore, the axial arrangement of the check valve to the work chamber no longer affects the design of the adjustment angle. It is further advantageous that through the axial stacking of the volume accumulator, check valve, and work chamber, the installation is considerably simplified, because the components that carry these functions can be placed one above the other in an installation direction, instead of nested one in the other.

A vacuum-pressurized work chamber can be produced by camshaft alternating moments. A vacuum-pressurized work chamber can also be understood to the effect that this vacuum-pressurized work chamber has a lower pressure than the chamber to be reduced during the adjustment process of the camshaft adjuster. The vacuum pressure in the vacuum pressurized work chamber thus can be the result of various causes, e.g., oscillations of the camshaft, oscillations of the control drive, especially the traction mechanism during operation or oscillations of the crankshaft that are transferred through the control drive to the camshaft adjuster. Starting from each cause, the work chamber experiences a drop in pressure that opens the check valve and suctions the hydraulic medium present in the volume accumulator.

The volume accumulator in the cover element can be arranged in an axial position or in a radial position relative to the work chamber or to the work chambers.

Alternatively, the check valve can be constructed in a radial position between the cover element and the drive element, if the cover element surrounds the drive element and the check valves are arranged on the area surrounding the drive element, e.g., in the form of a circumferential collar. The volume accumulator in the cover element can be arranged here in an axial position relative to the work chamber or in a radial position relative to the work chamber.

In one construction of the invention, the check valve is formed by an intermediate washer arranged between the drive element and the cover element. The intermediate washer can have multiple check valves, wherein one check valve is allocated to each work chamber. The spring force-loaded check valves can be installed as an assembly in the intermediate washer. Then the intermediate washer can be placed on the drive element and covered by the cover element that has formed the volume accumulator. The three components are locked in rotation by the screws known to the prior art. Advantageously, the intermediate washer has the passage holes for the screws, wherein thus also the positionally correct allocation of the check valves relative to the work chambers is guaranteed and the intermediate washer can no longer rotate relative to the drive element or the work chamber. Thus, the position of the check valves to the work chambers themselves is guaranteed during operation of the camshaft adjuster. Advantageously, all check valves, along with the intermediate washer, are joined in a single installation step with the drive element.

In one advantageous construction, the intermediate washer is a sheet-metal part and the check valve is constructed as a sheet-metal flap formed integrally with the sheet-metal part. The check valves can be easily punched from the sheet metal and are held captively with the intermediate washer by the integral construction. The installation of a spring that loads the check valve is unnecessary due to the integral construction from sheet metal. The thin-walled construction of the intermediate washer from sheet metal saves installation space.

In one especially preferred construction, the intermediate washer is arranged between the drive element and a cover element that is fastened to the drive element and formed as a sealing cover. Advantageously, the intermediate washer can support the sealing function. For this purpose, the intermediate washer can have raised sections that surround the fluid-tight areas, e.g., around the work chambers, when the sealing cover is installed with the drive element. These raised sections surrounding the work chambers can be formed alternatively or additionally by the sealing cover, in order to further increase the sealing function. This embodiment thus provides that the intermediate washer is axially directly adjacent to the work chambers.

In one construction of the invention, the check valve projects into the work chambers in the open state. The opening of the check valve is caused by a vacuum pressure caused by camshaft alternating moments in the corresponding work chambers. Advantageously, the hydraulic medium can pass on a direct path through the opening cross section of the check valve from the volume accumulator and flow into the work chambers.

In one preferred construction, the opening path of the check valve is bounded by a stop formed by the drive element. The stop formed by the drive element is formed by a vane of the drive element and has the shape of a stepped surface. Advantageously, the opening path of the check valve is bounded by the stop, in order to prevent damage of the check valve due to collisions of the opened check valve with the driven element. For sufficient clearance in the movement of the check valve, the driven element can also have corresponding material recesses.

In another construction of the invention, the cover element is formed integrally with the drive element and the check valve is arranged on the surface of the cover element facing the work chamber. For the drive element with a cup-shaped construction, the check valve can be easily fed from the open side to the base of the cup shape.

Alternatively, the drive element can be constructed integrally with the cover element, so that a cup-shaped drive element exists. The check valves are arranged on the side of the base of the cup-shaped drive element facing away from the work chamber and can be covered by a second cover element that has, e.g., the oil guide from the volume accumulator to the check valves. The base of the cup-shaped drive element directly bounds the work chambers in the axial direction and has corresponding oil holes that lead the hydraulic medium from the check valves to the work chambers.

The check valves can be constructed by an intermediate washer that is arranged between the base of the cup-shaped drive element and the second cover element.

The volume accumulator can be formed solely by the second cover element. The second cover element advantageously has a funnel-shaped construction that collects the emerging hydraulic medium and feeds it to the volume accumulator.

Alternatively, the volume accumulator can be formed by the second cover element with a third cover element. The third cover element has a funnel-shaped construction that collects the emerging hydraulic medium and feeds it to the volume accumulator.

Ideally, the previously mentioned oil holes of the cover elements are aligned in the axial direction, so that a shortest possible oil channel without branches or bends is formed.

In an alternative embodiment, the intermediate washer is arranged between a sealing cover fastened to the drive element and a cover element formed as a spring cover. Advantageously, the intermediate washer now fulfills only the function of supporting the check valves. The sealing function is achieved between the sealing cover and the drive element. Therefore, the intermediate washer can have a simpler construction. The spring cover can be formed as the volume accumulator that collects emerging hydraulic medium due to centrifugal force and the intermediate washer can output this hydraulic medium through the check valve and through the sealing cover to the work chamber.

Preferably, this alternative embodiment provides that the check valve projects into the sealing cover in the open state. Advantageously, this arrangement allows material recesses to be eliminated on the drive element and on the driven element for the opening path of the check valve.

The alternative construction has a stop formed by the sealing cover that bounds the opening path of the check valve. The stop formed by the sealing cover can have the shape of a stepped surface that can be shaped easily. Advantageously, the opening path of the check valve is bounded by the stop, in order to define the maximum flow rate. The flow rate should be adapted to the cross sections of the openings to the work chamber, in order to avoid a throttling effect by the check valve.

Through the arrangement of the volume accumulator, the check valve, and the work chamber in the axial direction one following the other according to the invention, a stacked arrangement and thus a simple construction of the camshaft adjuster is achieved.

BRIEF DESCRIPTION OF THE DRAWINGS

Embodiments of the invention are shown in the figures. Shown are.

DETAILED DESCRIPTION

Figure 1:
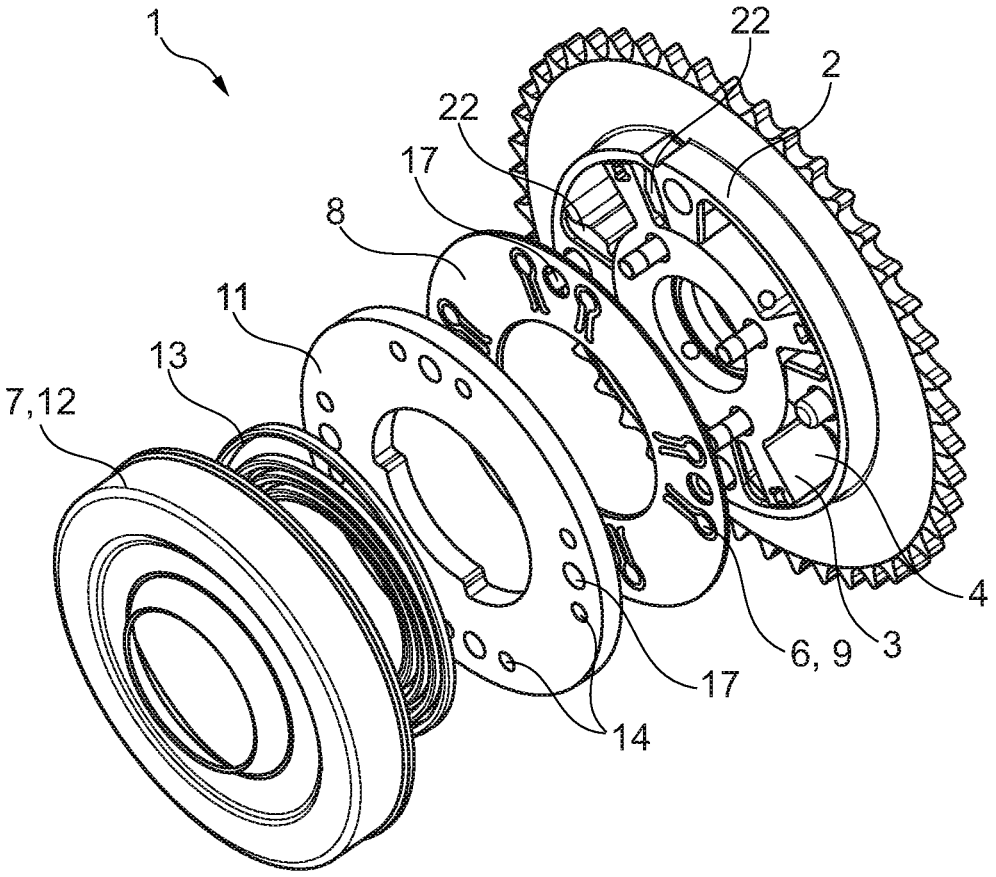
FIG. 1 a camshaft adjuster according to the invention in an exploded-view diagram, FIG. 2 the camshaft adjuster according to the invention according to FIG. 1 in longitudinal section, FIG. 3 a detail view of the camshaft adjuster according to FIG. 2, FIG. 4 a perspective view of the intermediate washer of the camshaft adjuster according to FIG. 1, FIG. 5 a perspective view of the sealing cover of the camshaft adjuster according to FIG. 1, FIG. 6 a schematic view of the camshaft adjuster according to the invention with fill level optimization, and FIG. 7 a perspective view of the drive element 2 with axial open areas 22.

FIG. 1 shows a camshaft adjuster 1 according to the invention in an exploded-view diagram.

The camshaft adjuster 1 has a drive element 2, a driven element 3, an intermediate washer 8, a sealing cover 11, a spring 13, and a spring cover 12. The previously specified components are arranged in the axial direction in the specified sequence one after the other. The drive element 2 and the driven element 3 form multiple work chambers 4 that can be pressurized with hydraulic medium. A check valve 6 that is formed integrally with the intermediate washer 8 is allocated to each work chamber 4. The intermediate washer 8 is a thin-walled sheet-metal part. The contour of the check valves 6 is stamped so that the spring force loading of the check valve 6 is realized as a bending beam for returning into the rest position in which the check valve 6 covers an opening 14. The check valve 6 covers the circular opening 14 with the circular end. A hydraulic medium flow initially flows into the opening 14, a vacuum pressure in the work chamber 4 opens the corresponding check valve 6 in which it draws the check valve 6 formed as a sheet-metal flap into the work chamber 4 and then the hydraulic medium can flow out of the opening 14 into the work chamber 4 and can equalize the deficient volume due to the vacuum pressure. In this way, the adjustment speed increases. The openings 14 of the sealing cover 11 are passage holes and open into the volume accumulator 7 that is formed by the spring cover 12. The volume accumulator 7 is filled by hydraulic medium ejected from the camshaft adjuster 1, advantageously from a tank connection of a central valve (shown partially in FIG.

2). The spring cover 12 also covers, in addition to the function of the volume accumulator 7, the spring 13 that tensions the drive element 2 and the driven element 3 to each other in a circumferential direction.

Figure 2:
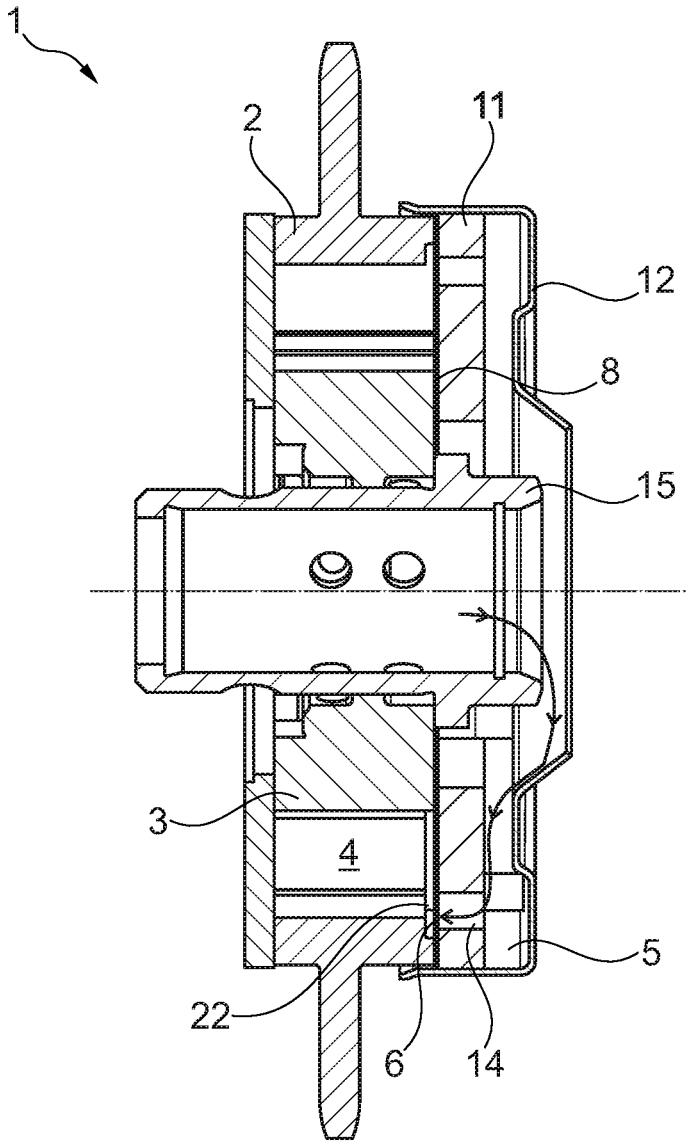

FIG. 2 shows the camshaft adjuster 1 according to the invention in accordance with FIG. 1 in a longitudinal section.

A central valve 15 (here shown simplified as a central screw) fastens the driven element 3 locked in rotation with a camshaft not shown here. A flow of hydraulic medium is shown by the line with arrows. The end-side outflow of hydraulic medium from the central valve 15 is collected during operation of the camshaft adjuster 1 by the funnel-shaped construction of the spring cover 12 and collects in a volume accumulator 5 on the radially outer inner edge of the spring cover 12 due to centrifugal force. The spring 13 is omitted for better illustrating the hydraulic medium path. After a certain fill level in the volume accumulator 5 is exceeded, a part of the collected hydraulic medium can be fed via an opening 14 through a check valve 6 of the work chamber 4 or is suctioned due to the check valve 6 opening into the work chamber 4 due to the vacuum pressure in the work chamber 4 caused by alternating moments of the camshaft. The intermediate washer 8 is clamped by the sealing cover 11 and the drive element 2. The oil holes 14 that are covered by the check valves 6 are arranged radially spaced apart relative to the rotational axis of the camshaft adjuster 1 such that a minimum fill level in the volume accumulator 5 already provides sufficient hydraulic medium for equalizing the hydraulic medium deficiency caused by the vacuum pressure in the work chamber 4. In this embodiment, the openings 14 are adjacent to the radially outer walls of the work chamber 4. Alternatively, the openings 14 can also be arranged adjacent to a radially inner wall of the work chamber 4. Another alternative provides that the openings 14 are preferably arranged centrally between the two previously mentioned conceivable positions.

Figure 3:
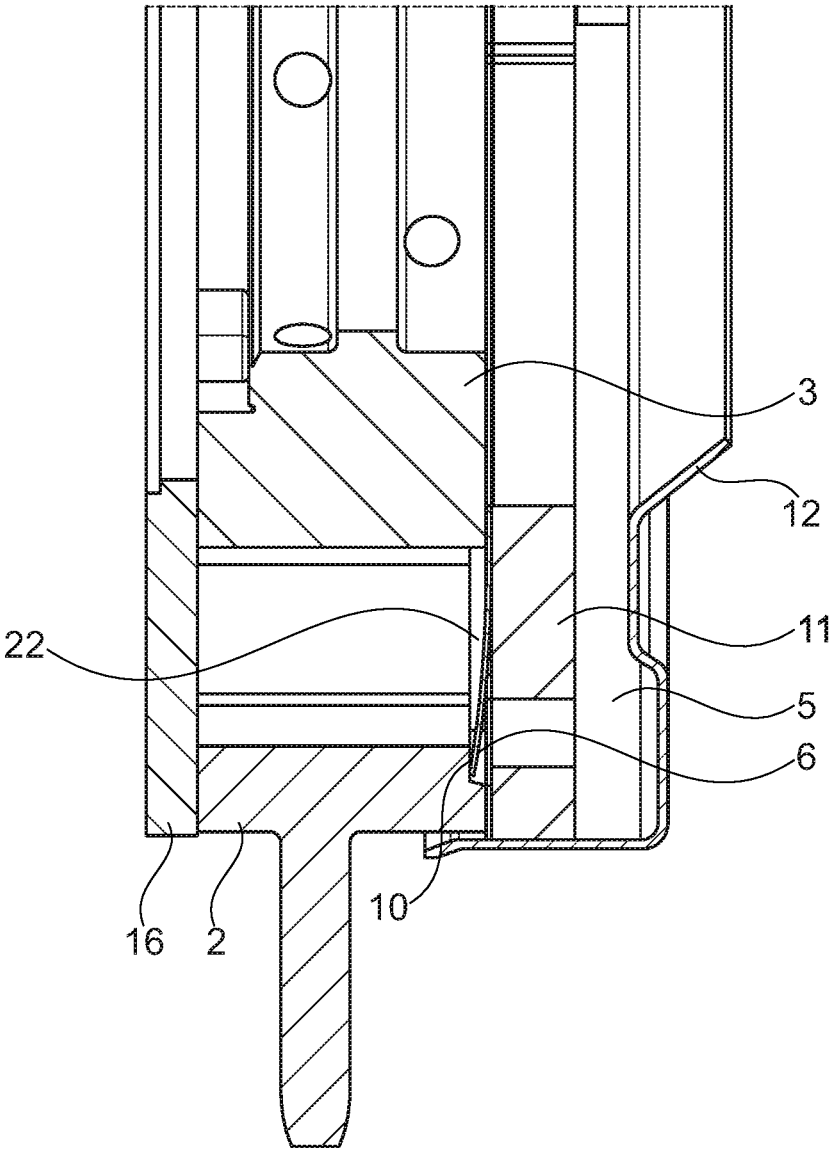

FIG. 3 shows a detailed view of the camshaft adjuster 1 according to FIG. 2.

Figure 7:
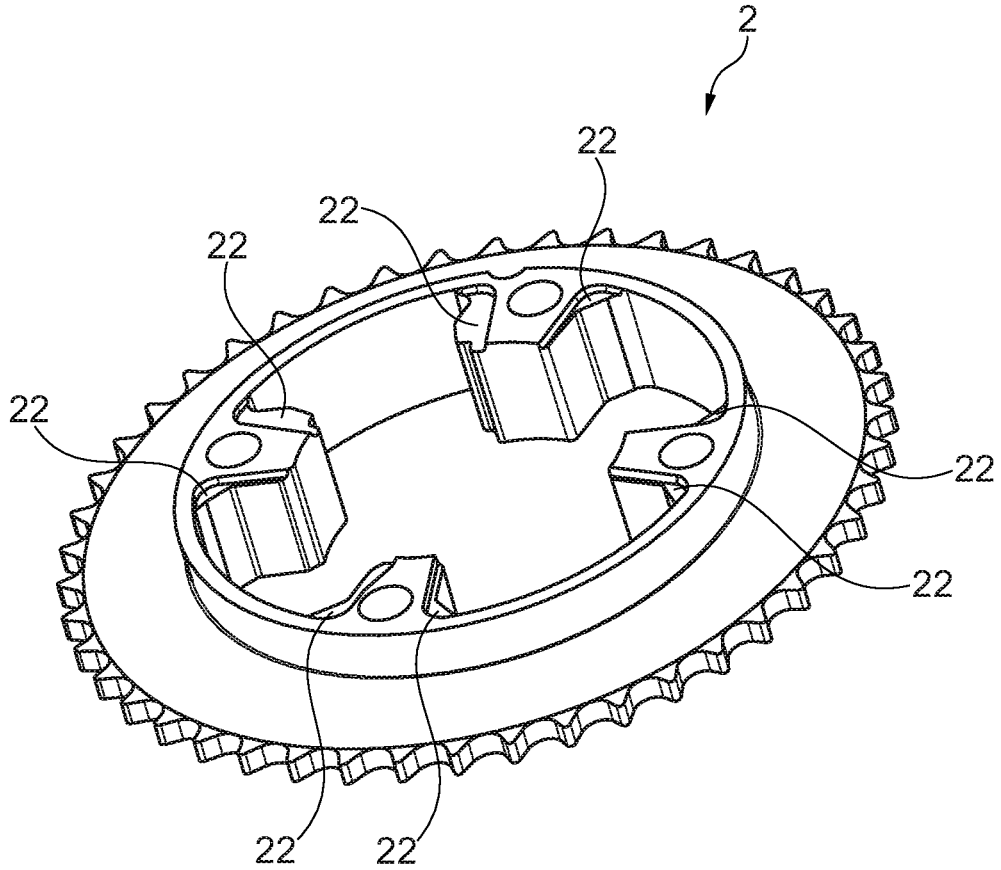

The opened check valve 6 contacts the stop 10. The stop 10 is formed by the drive element 2 as an integrally formed projection and is arranged partially within a vane of the drive element 2. If the drive element 2 contacts the driven element 3 in the circumferential direction, axial open areas 22 are provided that form, on one hand, the stops 10 and whose individual contours are largely adapted to the respective contours of the check valve 6. For example, through the axial open area 22 on the drive element 2 it is possible that the check valves 6 can then still open if the drive element 2 contacts the driven element 3 in the circumferential direction or both elements 2, 3 contact each other. The axial open areas 22 are easily visible in FIG. 7. The cover 16 arranged on the side of the camshaft adjuster 1 facing the camshaft and locked in rotation with the drive element 2 closes the work chambers 4 essentially sealed against the pressurizing medium. The funnel-shaped construction of the spring cover 12 promotes the collection of the flowing hydraulic medium.

Figure 4:
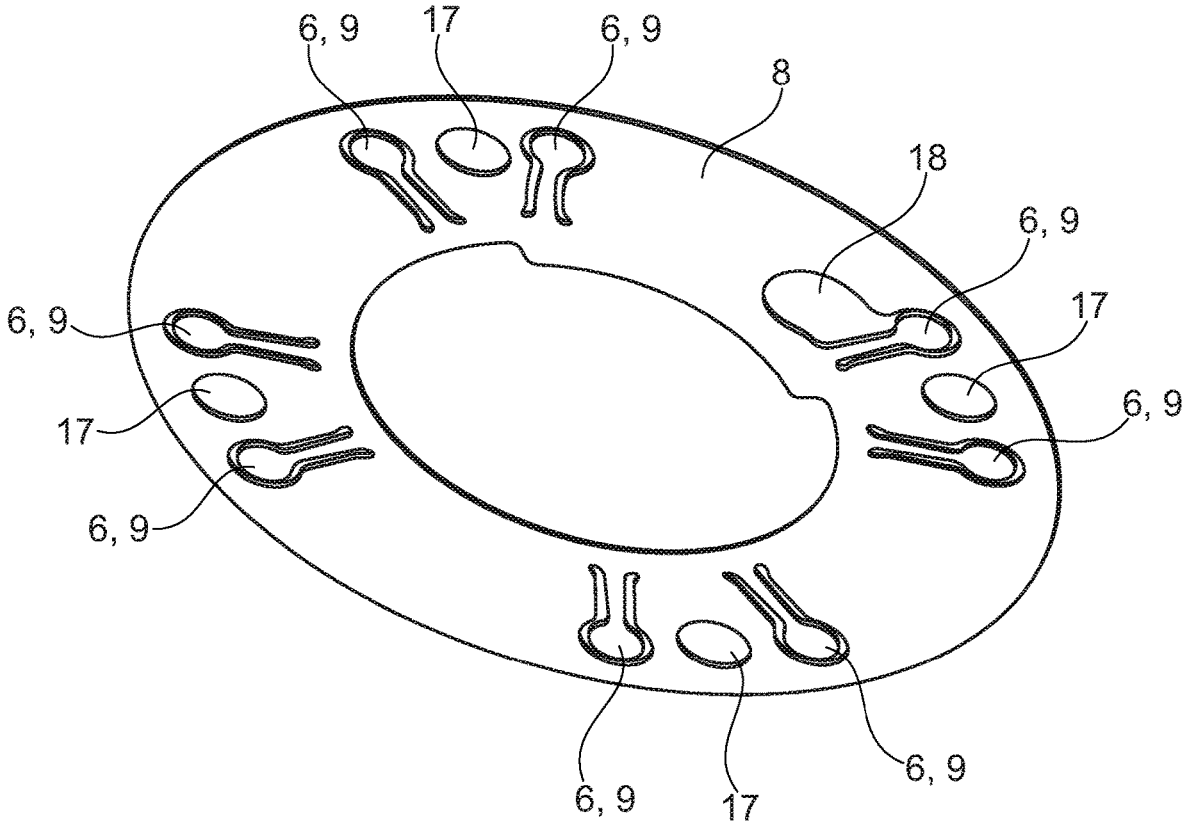

FIG. 4 shows a perspective view of the intermediate washer 8 of the camshaft adjuster 1 according to FIG. 1.

The intermediate washer 8 is constructed as a thin-walled sheet and has four pairs of check valves 6 that are allocated to the work chambers 4. The contour of the check valves 6 can be easily punched from sheet metal. In addition, four openings 17 are provided on which each is arranged between a pair of check valves 6 and are provided for the passage of the fastening screws that tension the sealing cover 11 and the cover 16 with the drive element 2. In addition, the intermediate washer 8 has an opening 18 that can be passed through by a locking piston that can couple the drive element 2 with the driven element 3 or can allow decoupling for exerting a relative rotation. The locking piston is held by the driven element 3 and can engage in a locking connecting link 19 that is provided for this purpose and is arranged in the sealing cover 11. Because the intermediate washer 8 is arranged between the sealing cover 11 and the drive element 2, the opening 18 provides the necessary clearance so that the locking piston can come in contact with the locking connecting link 19. The opening 18 is only optional and is caused by the arrangement of the locking connecting link 19 in the directly adjacent component. If the locking connecting link 19 is located on the axially opposite side of the camshaft adjuster 1 on another cover, then this opening 18 on the intermediate washer 8 can be omitted.

Figure 5:
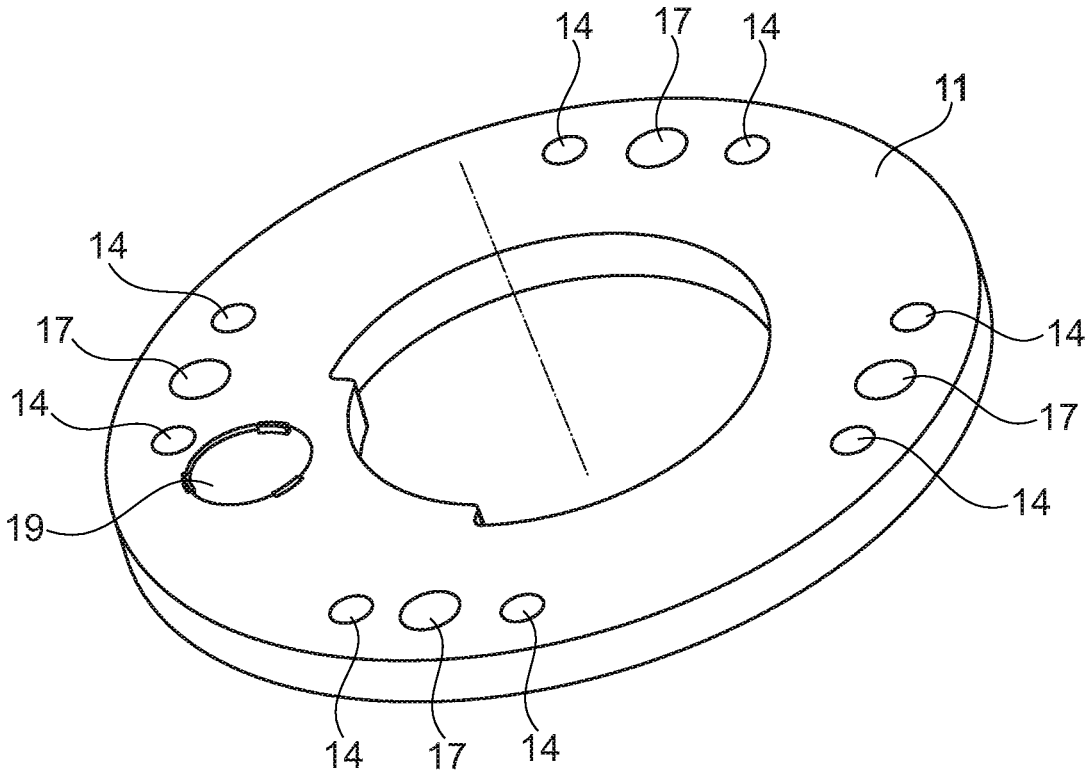

FIG. 5 shows a perspective view of the sealing cover 11 of the camshaft adjuster 1 according to FIG. 1.

The sealing cover 11 has the openings 17 provided for the fastening screws. These openings 17 are flanked by the oil holes 14 that are covered in the assembly of the camshaft adjuster 1 by the check valves 6 of the intermediate washer 8. In addition, the locking connecting link 19 is formed by the sealing cover 11, which—as shown here—can have a circular shape or can be constructed as a groove. An insert element can also be provided for insertion into the locking connecting link 19, with which the locking piston can come in contact.

Figure 6:
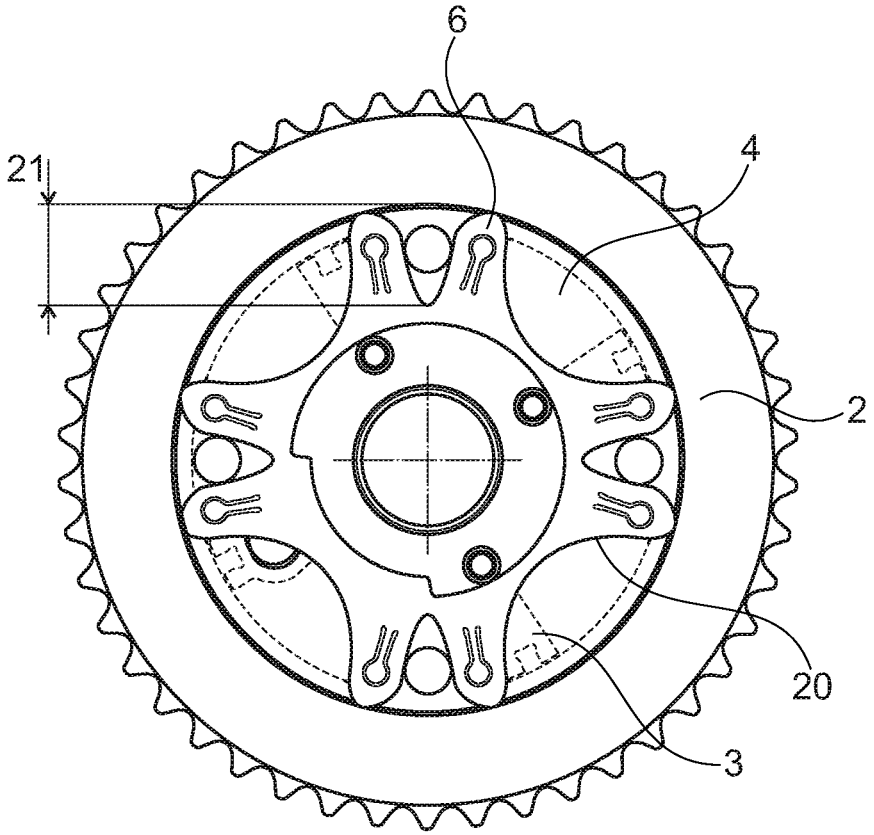

FIG. 6 shows a schematic diagram of the camshaft adjuster 1 according to the invention with fill level optimization.

The volume accumulator 5 formed by a cover element 7 can deviate from the circular ring shape shown in the previous figures. In FIG. 6, with reference to the profile of the fill contour 20, it is shown how the shape of the volume accumulator 5 can be optimized with respect to the accessibility of the stored hydraulic medium to the check valves 6. For example, as seen in the circumferential direction, the profile is formed with a slight radial distance to the rotational axis or center of the camshaft adjuster approximately in the middle between two check valves 6. The radial distance increases in the areas of the check valves 6 and ideally completely surrounds the check valves 6. Thus, advantageously the hydraulic medium collected by the funnel-shaped cover element 7 is forced by the centrifugal force during operation of the camshaft adjuster 1 into the pockets of the volume accumulator 5 and can be fed to the work chamber 4 controlled by the check valve 6 arranged in this area. Thus, the maximum fill level 21 is applied for each check valve 6. The volume of hydraulic medium in the pocket-shaped areas of the volume accumulator with the maximum fill level 21 ideally corresponds at least to the needs of the corresponding work chamber 4. The fill contour 20 can be formed by the cover element 7 forming the volume accumulator 5 or by a separate fill contour component that is joined to the cover element 7.

LIST OF REFERENCE SYMBOLS

1) Camshaft adjuster
2) Drive element
3) Driven element
4) Work chamber
5) Volume accumulator
6) Check valve
7) Cover element
8) Intermediate washer

9) Sheet-metal flap
10) Stop
11) Sealing cover
12) Spring cover
13) Spring
14) Oil hole
15) Central valve
16) Cover
17) Opening (for screw)
18) Opening (for locking piston)
19) Locking connecting link
20) Fill contour
21) Fill level
22) Axial open area

The invention claimed is:

1. A camshaft adjuster comprising:
a drive element,
a driven element that is configured to rotate relative to the drive element within an angular range and is adapted to be connected to a camshaft,
work chambers located between the drive element and the driven element, the work chambers are configured to rotate the driven element relative to the drive element,
a volume accumulator adapted to collect hydraulic medium and formed by a sealing cover and a spring cover, the spring cover being locked in rotation with the drive element,
a check valve allocated to each of the work chambers,
the volume accumulator feeds the hydraulic medium via the check valve of a vacuum-pressurized one of the work chambers via vacuum pressure in the work chamber opening the check valve,
each of the check valves is arranged in an axial position between the work chambers and the volume accumulator.

2. The camshaft adjuster according to claim 1, wherein the check valves are formed by an intermediate washer arranged between the drive element and the spring cover.

3. The camshaft adjuster according to claim 2, wherein the intermediate washer is a sheet-metal part and the check valves are each constructed as a sheet-metal flap formed integrally with the sheet-metal part.

4. The camshaft adjuster according to claim 1, wherein the check valves each project into an associated one of the work chambers in an open state.

5. The camshaft adjuster according to claim 1, wherein an opening path of each of the check valves is bounded by a stop formed by the drive element.

6. A camshaft adjuster comprising:
a drive element,
a driven element that is configured to rotate relative to the drive element within an angular range and is adapted to be connected to a camshaft,
work chambers located between the drive element and the driven element, the work chambers being configured to rotate the driven element relative to the drive element,
a volume accumulator adapted to collect hydraulic medium and formed by a sealing cover and a spring cover, the spring cover being locked in rotation with the drive element,
a check valve allocated to each of the work chambers in an axial position between the work chambers and the volume accumulator, and
wherein the volume accumulator feeds the hydraulic medium via the check valves to the work chambers upon a vacuum pressure in the work chambers opening the check valves.

7. The camshaft adjuster of claim 6, further comprising an intermediate washer arranged between the drive element and the spring cover, and the check valves are formed on the intermediate washer.

8. The camshaft adjuster of claim 7, wherein the check valves are flaps formed integrally with the intermediate washer.

9. The camshaft adjuster of claim 6, wherein the check valves project into a respective one of the work chambers in an open state.

10. The camshaft adjuster of claim 6, further comprising a stop formed on the drive element, and an opening path of the check valves is bounded by the stop.

11. A camshaft adjuster comprising:
a drive element,
a driven element that is configured to rotate relative to the drive element within an angular range and is adapted to be connected to a camshaft,
work chambers located between the drive element and the driven element, the work chambers being configured to rotate the driven element relative to the drive element,
a volume accumulator adapted to collect hydraulic medium and formed by a sealing cover and a spring cover, the spring cover being locked in rotation with the drive element,
a check valve allocated to each of the work chambers in an axial position between the work chambers and the volume accumulator, wherein an opening stroke of each of the check valves is bounded by a stop formed by the drive element,
wherein the volume accumulator feeds the hydraulic medium via the check valves to the work chambers upon a vacuum pressure in the work chambers opening the check valves.

* * * * *